US010131038B2

(12) United States Patent
Chien

(10) Patent No.: US 10,131,038 B2
(45) Date of Patent: Nov. 20, 2018

(54) RATCHET WRENCH HAVING FLEXIBLE POSITIONING STRUCTURE

(71) Applicant: YIH CHENG FACTORY CO., LTD., Nantuo (TW)

(72) Inventor: Chih-Hung Chien, Nantuo (TW)

(73) Assignee: YIH CHENG FACTORY CO., LTD., Nantuo (TW)

( * ) Notice: Subject to any disclaimer, the term of this patent is extended or adjusted under 35 U.S.C. 154(b) by 190 days.

(21) Appl. No.: 15/185,088

(22) Filed: Jun. 17, 2016

(65) Prior Publication Data

US 2017/0361435 A1 Dec. 21, 2017

(51) Int. Cl.

| | |
|---|---|
| ***B25B 23/00*** | (2006.01) |
| ***B25B 13/46*** | (2006.01) |
| ***B25B 13/48*** | (2006.01) |
| *B25G 1/06* | (2006.01) |

(52) U.S. Cl.

CPC ..... *B25B 23/0028* (2013.01); *B25B 13/461* (2013.01); *B25B 13/481* (2013.01); *B25G 1/063* (2013.01); *B25G 1/066* (2013.01)

(58) Field of Classification Search

CPC . B25B 23/0028; B25B 13/461; B25B 13/481; B25B 13/463; B25B 13/462; B25B 23/0035

See application file for complete search history.

(56) References Cited

U.S. PATENT DOCUMENTS

| | | | | |
|---|---|---|---|---|
| 1,453,607 | A * | 5/1923 | Saucier | B25B 13/465 81/124.3 |
| 2,504,796 | A * | 4/1950 | Boyd | B25B 23/0021 403/93 |
| 5,363,727 | A * | 11/1994 | Barth | B25G 1/043 81/177.2 |
| 6,167,787 | B1 * | 1/2001 | Jarvis | B25B 23/0021 81/177.2 |
| 6,349,620 | B1 * | 2/2002 | Anderson | B25G 1/007 81/177.9 |
| 7,975,575 | B2 * | 7/2011 | Hu | B25B 13/461 81/177.7 |
| 8,511,206 | B2 * | 8/2013 | Hong | B25G 1/063 81/177.8 |
| 2005/0166718 | A1 * | 8/2005 | Chang | B25B 13/46 81/60 |

* cited by examiner

*Primary Examiner* — Monica Carter
*Assistant Examiner* — Danny Hong
(74) *Attorney, Agent, or Firm* — Chun-Ming Shih; HDLS IPR Services

(57) ABSTRACT

A ratchet wrench having a flexible positioning structure includes a drive bar, a rotary head, and a locking button. The drive bar includes a fork arm, an axial hole, and a radial hole communicating with the axial hole. The rotary head is pivotally connected to the fork arm; the rotary head includes a round housing, a plurality of positioning recesses disposed on the round housing, and a pivot axis passing through the rotary head and two ends of the fork arm. The pivot axis is perpendicular to the radial hole. The locking button includes a flexible fastener inserted through the radial hole and a latch bar disposed in the axial hole. The flexible fastener is flexibly movable in association with movement of the latch bar, so that the latch bar is engaged with or released from any of the positioning recesses.

10 Claims, 7 Drawing Sheets

RATCHET WRENCH HAVING FLEXIBLE POSITIONING STRUCTURE

TECHNICAL FIELD

The present invention relates to a ratchet wrench and, in particular, to a ratchet wrench having a flexible positioning structure, wherein a rotary head is freely rotatable to some certain angles and can be quickly fastened or released by means of deformation of a flexible fastener.

BACKGROUND

The ratchet wrench is a common hand tool for tightening operations. The ratchet wrench can be used flexibly and can move back and forth freely to tighten or loosen blots, screws, or the likes, so it replaces a traditional wrench in many situations.

The ratchet wrench includes a head portion, a bar extending outwardly from the head portion, and a drive head disposed on the head portion. The drive head is drivingly associated with objects, e.g. nuts and bolts, by means of a variety of sleeves in different sizes. A user simply needs to hold the bar to swing it, and the objects can be loosened or tightened. However, the conventional ratchet wrench is often limited by a dead corner or a tiny space, and thereby the drive head of the ratchet wrench cannot fasten the objects smoothly. In solution, there is a ratchet wrench with a drive head rotatable with respect to the bar. However, the ratchet wrench with the rotatable drive head has a complicated structure for fixing the drive head, and its inconvenient operations cannot meet the market's expectations.

Accordingly, the inventor made various studies to solve the above-mentioned problems, on the basis of which the present invention is accomplished.

SUMMARY

It is an object of the present invention to provide a ratchet wrench having a flexible positioning structure, wherein by operating a flexible fastener, a rotary head can be quickly released or fastened by deformation of the flexible fastener.

Accordingly, the present invention provides a ratchet wrench having a flexible positioning structure, comprising a drive bar, a rotary head and a locking button. The drive bar includes a fork arm, a fork opening formed at the fork arm, an axial hole communicating with the fork opening, and a radial hole communicating with the axial hole. The rotary head is pivotally connected to two ends of the fork arm; the rotary head includes a round housing, a plurality of positioning recesses disposed on the round housing, and a pivot axis passing through the rotary head and two ends of the fork arm, wherein the pivot axis is perpendicular to the radial hole. The locking button includes a flexible fastener inserted through the radial hole and a latch bar disposed in the axial hole, the flexible fastener is flexibly movable in association with movement of the latch bar, and the latch bar is engaged with or released from any of the positioning recesses.

The present invention further has following merits. The rotary head can be fastened by pressing the flexible fastener of the locking button, and rotating the rotary head to the positioning recess, and then releasing the locking button. In addition, the locking button can automatically keep a locked state without the necessity of additional operations, and the rotary head is locked against free rotation, thereby achieving safety and convenience in operations.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Figure 1:
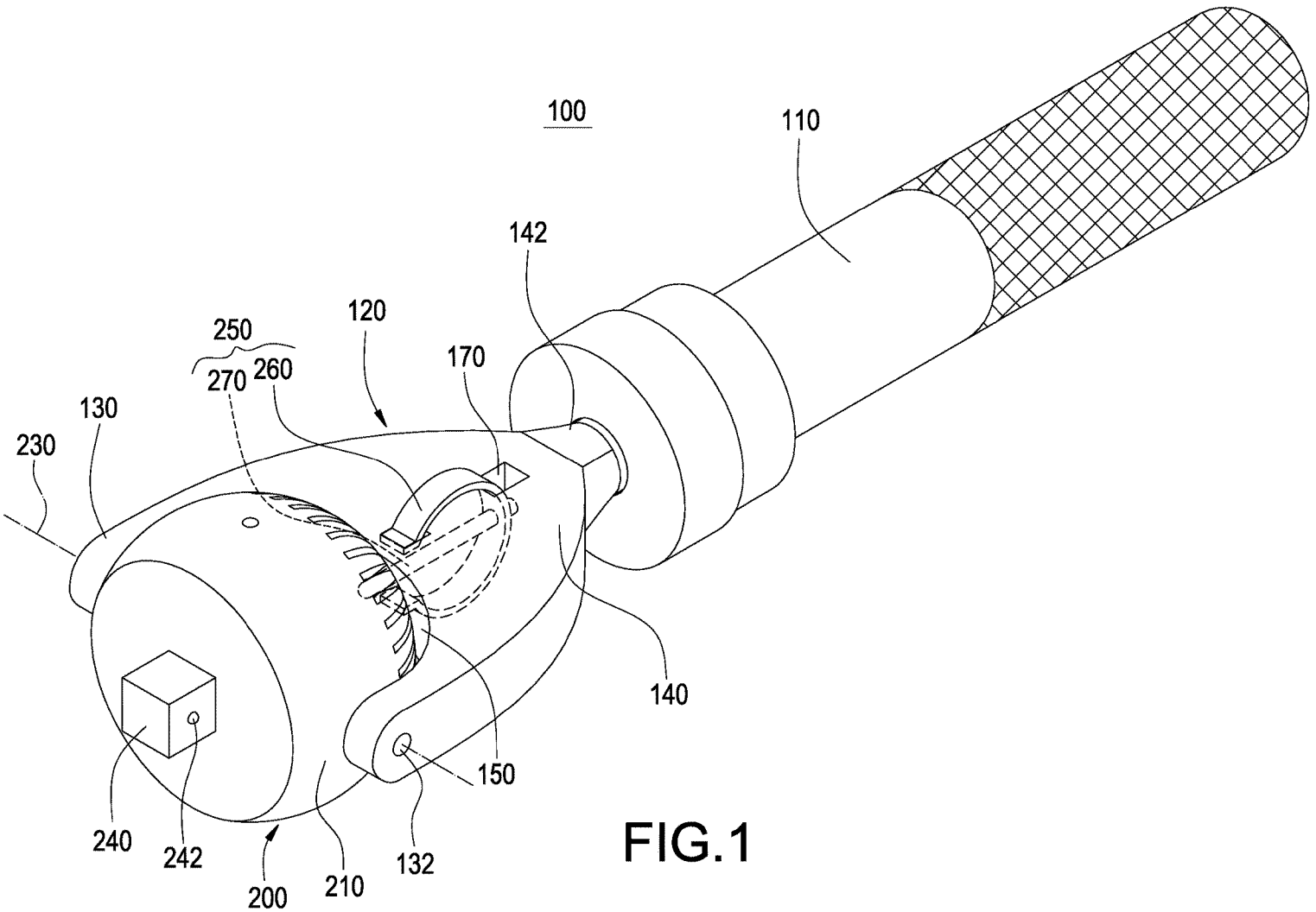
FIG. 1 is a perspective view of the present invention, illustrating a ratchet wrench having a flexible positioning structure.

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Referring to FIGS. 1 to 6, the present invention provides a ratchet wrench 100 having a flexible positioning structure, comprising a drive bar 120, a rotary head 200 and a locking button 250. In the present embodiment, the ratchet wrench 100 preferably further includes an operation handle 110 for receiving the drive bar 120. By quickly rotating the operation handle 110 when the ratchet wrench 100 is in an upright state or by moving back and forth the operation handle 110 when the ratchet wrench 100 is in a horizontal state, the rotary head 200 tightens or loosens an object (not illustrated).

The drive bar 120 includes a fork arm 130, a fork opening 150 formed at the fork arm 130, an axial hole 160 communicating with the fork opening 150, and a radial hole 170 communicating with the axial hole 160. As shown in the drawing, the fork arm 130 includes two forks (not labelled); the fork opening 150 is formed between the two forks. The rotary head 200 is pivotally connected to two ends of the fork arm 130. The rotary head 200 includes a round housing 210, a ratchet apparatus (not illustrated) disposed inside the round housing 210, a plurality of positioning recesses 220 disposed on the round housing 210, and a pivot axis 230 passing through the rotary head 200 and the two ends of the fork arm 130, wherein the pivot axis 230 is perpendicular to the radial hole 170.

The rotary head 200 includes an output element 240 in a rectangular shape protruding from one end of the round housing 210, a positioning ball 242 at one side surface of the output element 240, and the ratchet apparatus (not illustrated) connected to the rectangular output element 240. Moreover, the ratchet apparatus is disposed inside the round housing 210, and a variety of sleeves (not illustrated) in different sizes can be engagedly assembled to the output element 240 by means of the positioning ball 242 of the output element 240, so that the object can be tightened or loosened. The ratchet apparatus is a conventional apparatus, so a detailed description thereof is omitted for brevity.

In the present embodiment, the drive bar 120 further includes two supporting bolts 132, an enlarged end 140 and a bar body 142. The supporting bolts 132 are inserted through the two ends of the fork arm 130 respectively and are fixed between the round housing 210 and the fork arm 130. The pivot axis 230 is an imaginary line passing through an axle center of each supporting bolt 132, so that the rotary head 200 is freely rotatable about the pivot axis 230 at the fork opening 150 to certain angles, e.g. from 0 to 270 degrees. The enlarged end 140 is disposed between the fork arm 130 and the bar body 142. A size of the enlarged end 140 is greater than a size of the bar body 142. The axial hole 160 and the radial hole 170 are preferably disposed in the enlarged end 140. In other words, the locking button 250 is also disposed in the enlarged end 140, and therefore the ratchet wrench 100 of the present embodiment has better strength and provides superior operation quality.

Furthermore, the positioning recesses 220 at least include a first positioning recess 222 disposed on a top of the round housing 210 and a second positioning recess 224 disposed at each of two opposite sides of the round housing 210. The first positioning recess 222 and the second positioning recess 224 preferably form an included angle of 90 degrees therebetween, so that a user can operate the ratchet wrench 100 in an upright state, i.e. a central line of the output element 240 is aligned with an axis of the drive bar 120, or alternatively in a horizontal state, i.e. the central line of the output element 240 is perpendicular to the axis of the drive bar 120. The positioning recess 220 is preferably in a shape corresponding to the shape of a latch bar 270, so as to facilitate engagement of the latch bar 270 with the positioning recess 220.

Figure 7:
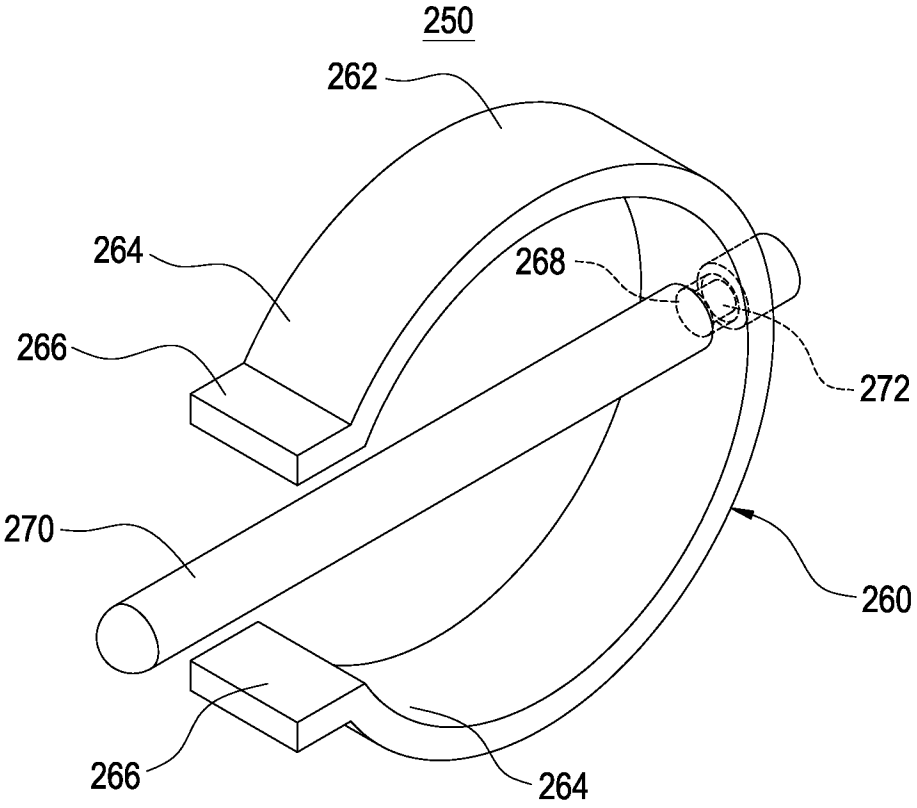
FIG. 7 is a perspective view of the present invention, illustrating a locking button of the ratchet wrench having the flexible positioning structure.

The locking button 250 includes a flexible fastener 260 disposed in the radial hole 170 and a latch bar 270 disposed in the axial hole 160. The flexible fastener 260 is flexibly movable in association with movement of the latch bar 270, so that the latch bar 270 is engaged with or released from any of the positioning recesses 220. Referring to FIG. 7, the flexible fastener 260 includes a connection portion 262 and two end portions 264, and the two end portions 264 are preferably integrally formed with the connection portion 262. The connection portion 262 passes through the radial hole 170, and the two end portions 264 protrude out of the radial hole 170 and are in contact with a surface of the drive bar 120.

In order to control the latch bar 270 to protrude out of or retract into the axial hole 160, the two end portions 264 of the flexible fastener 260 serve as pivots, so the latch bar 270 is driven to move by deformation of the connection portion 262. In the present embodiment, the flexible fastener 260 further includes two bend portions 266 connected to the two end portions 264, and two indentations 144 are disposed on a surface of the drive bar 120, i.e. disposed on two surfaces of the enlarged end 140, so that the two bend portions 266 are disposed at the two indentations 144 to be stably retained therein. However, in other different embodiments, the two end portions 264 of the flexible fastener 260 can be directly inserted on the surface of the drive bar 120 to serve as pivots.

The latch bar 270 includes a fastening portion 272 in the radial hole 170, and the connection portion 262 includes a through hole 268 or an opening engaged with the fastening portion 272. In the embodiment shown in FIGS. 2, 4, and 6, the fastening portion 272 is preferably an annular groove, so that the annular groove can be engaged with the through hole 268 or the opening. Furthermore, to avoid a circumstance in which the strength or operation quality of the drive bar 120 is reduced when the radial hole 170 is overly large in size to accommodate the latch bar 270 axially moving in a long distance, the drive bar 120 (i.e. the enlarged end 140) of the present invention further includes an accommodating recess 162 in communication with the radial hole 170. The accommodating recess 162 is disposed corresponding to the axial hole 160, so that the latch bar 270 can be disposed in the accommodating recess 162 when the latch bar 270 retracts.

Referring to FIG. 7, a cross section of the flexible fastener 260 is preferably a flat plate structure, and the flat plate structure is parallel to the surface of the drive bar 120, so as to facilitate a user's pressing the flexible fastener 260. The flexible fastener 260 herein is preferably a C-shaped fastener. However, in other different embodiment, the flexible fastener 260 can also be a trapezoidal fastener, a polygonal fastener or other suitable fastener. In addition, an end of the latch bar 270 preferably has a shape corresponding to a shape of each positioning recess 220, e.g. an arc shape or other suitable shape, so as to be engaged with each of the positioning recesses 220.

Figure 2:
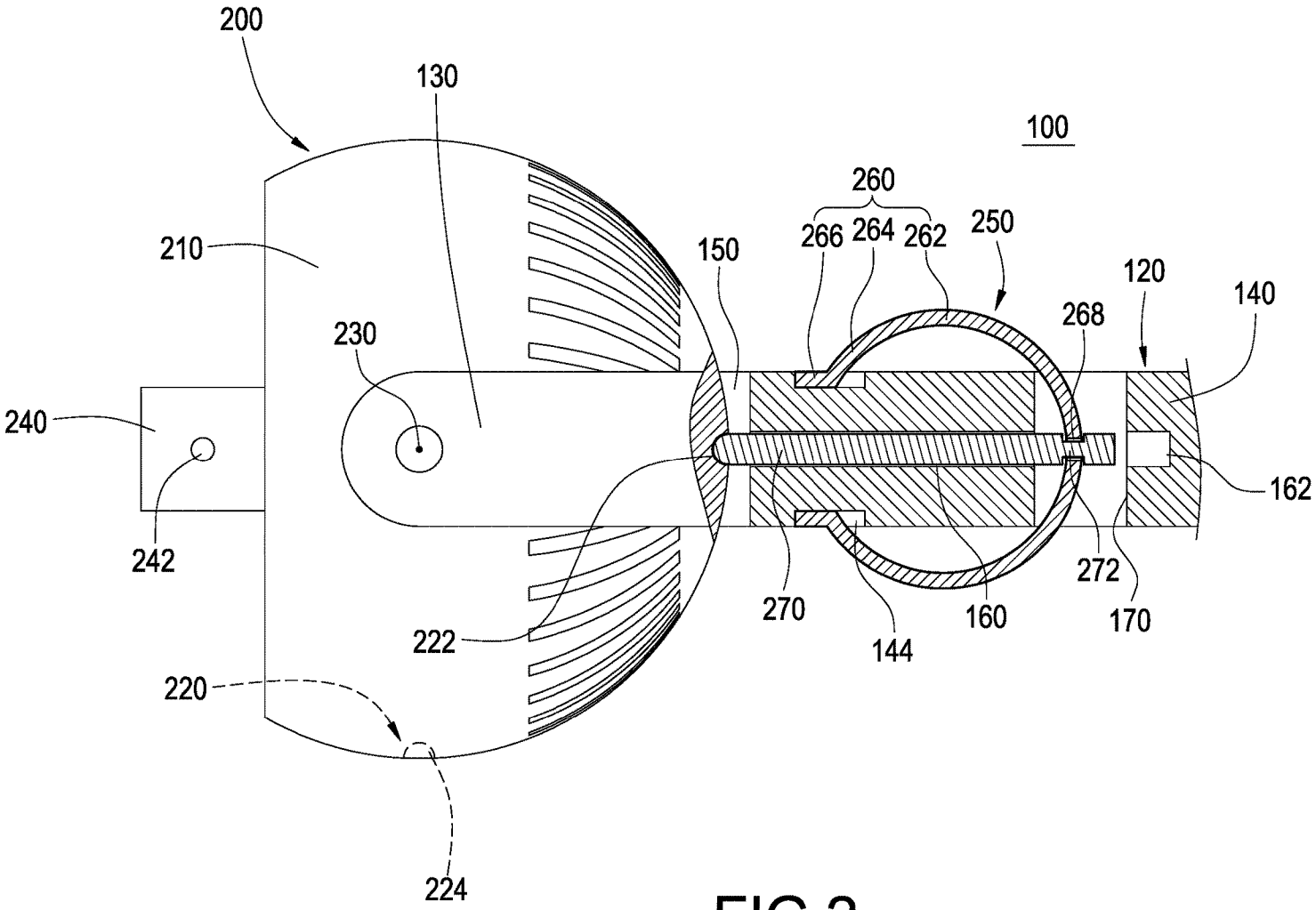
FIG. 2 is a partial cross-sectional view of the present invention, illustrating the ratchet wrench having the flexible positioning structure.
Figure 3:
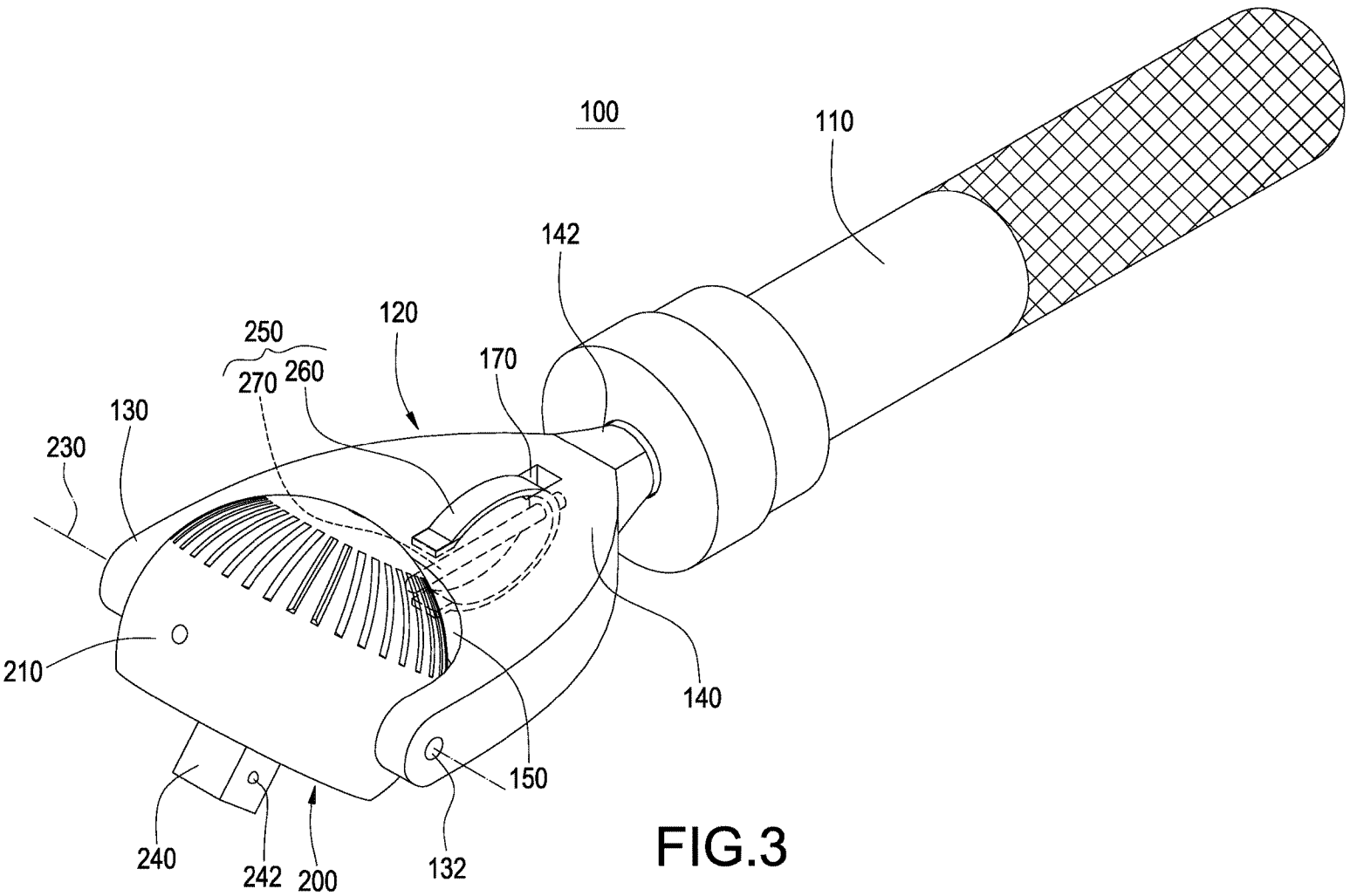
FIG. 3 is another perspective view of the present invention, illustrating the ratchet wrench having the flexible positioning structure.
Figure 4:
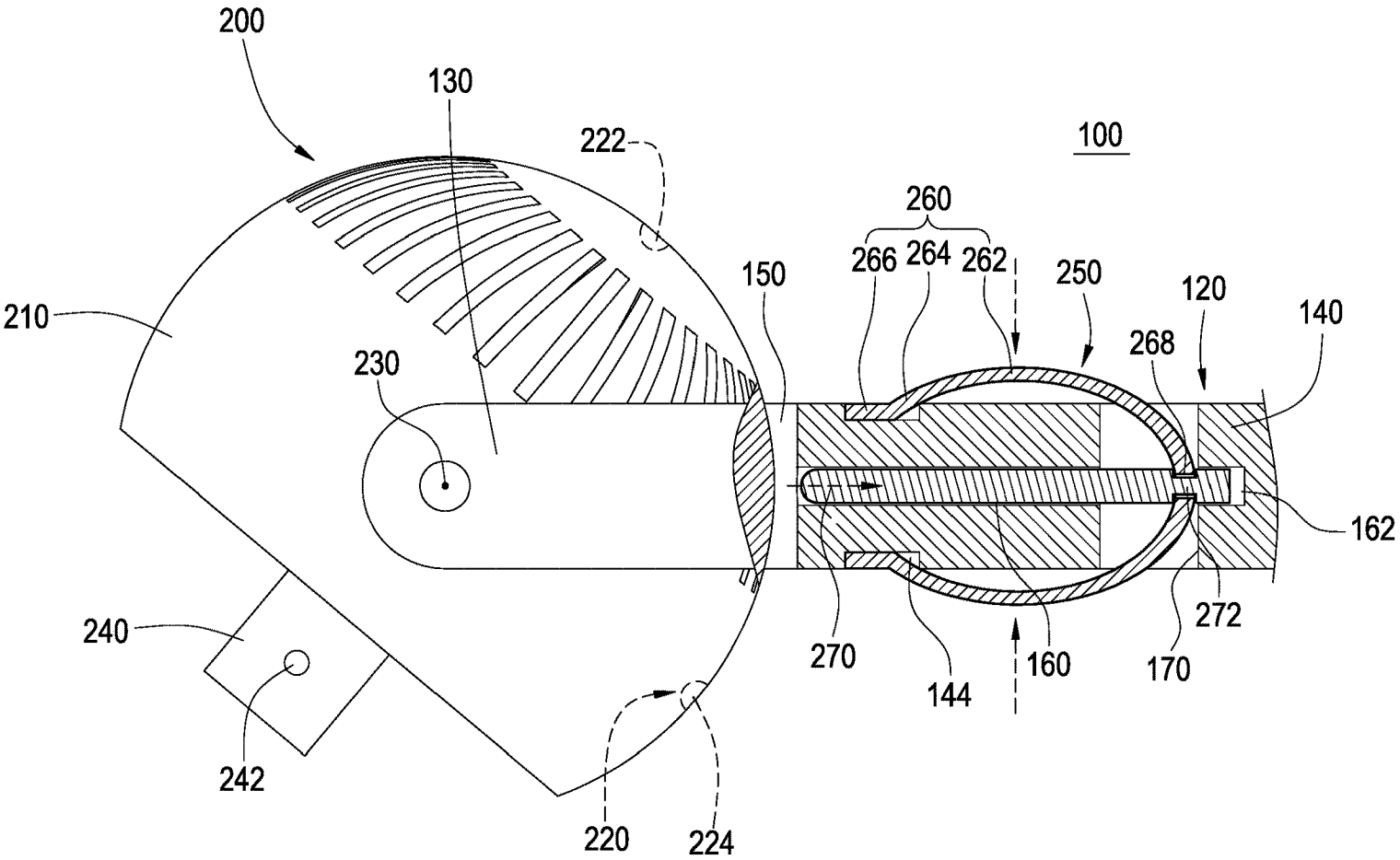
FIG. 4 is a partial cross-sectional view of FIG. 3.

How to operate the ratchet wrench 100 having the flexible positioning structure is more fully detailed as follows. Referring to FIGS. 1 and 2, when the flexible fastener 260 of the locking button 250 is under a no force condition, the latch bar 270 protrudes out of the fork opening 150 and is engaged with the first positioning recess 222 of the rotary head 200. At this point, the locking button 250 is in a locked state/position. Referring to FIGS. 3 and 4, when the flexible fastener 260 of the locking button 250 deforms under the action of a force, the movement of the connection portion 262 drives the fastening portion 272 of the latch bar 270 to move toward the accommodating recess 162 until the latch bar 270 is released from the first positioning recess 222. At this point, the locking button 250 is in a released state/position.

Figure 5:
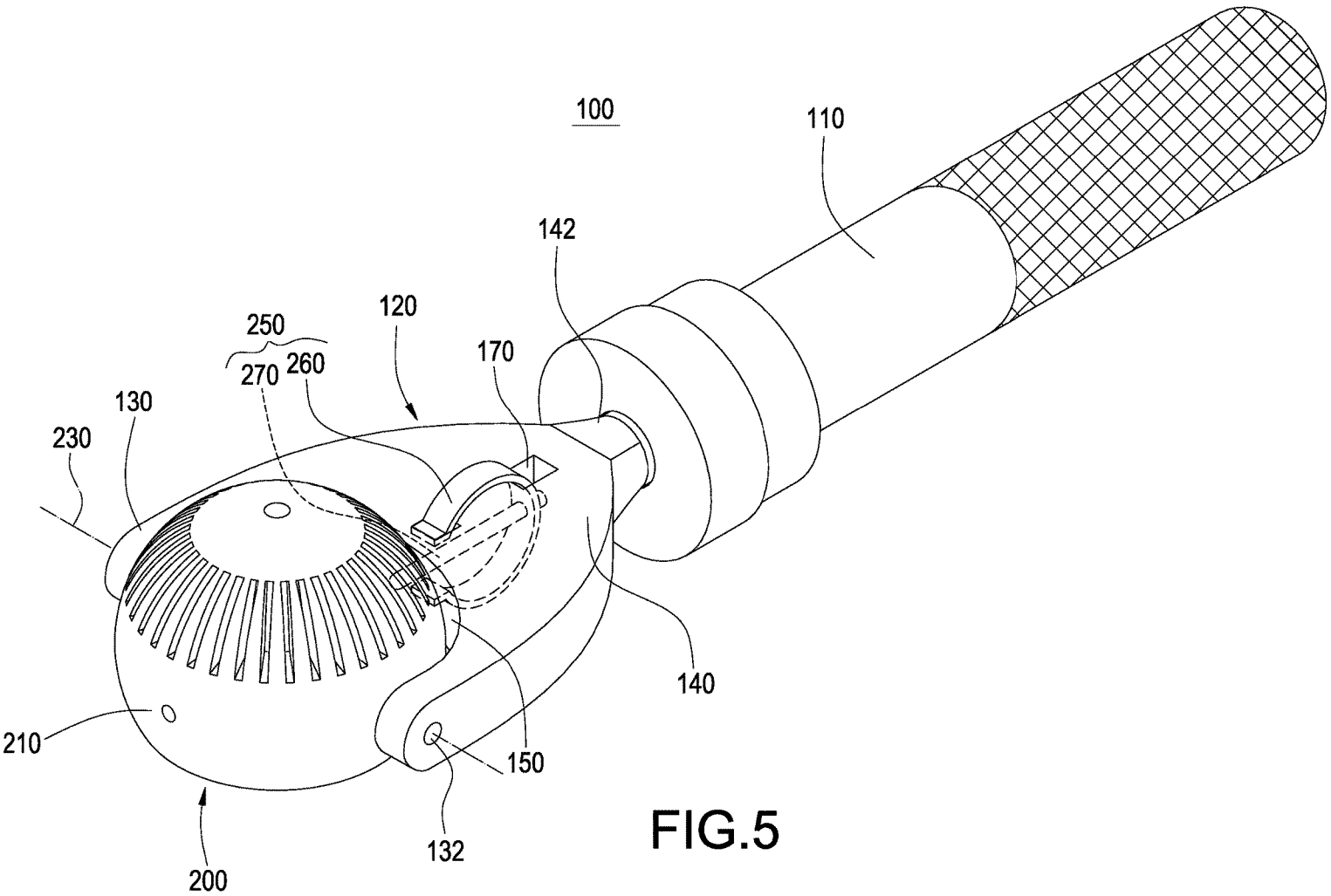
FIG. 5 is still another perspective view of the present invention, illustrating the ratchet wrench having the flexible positioning structure.
Figure 6:
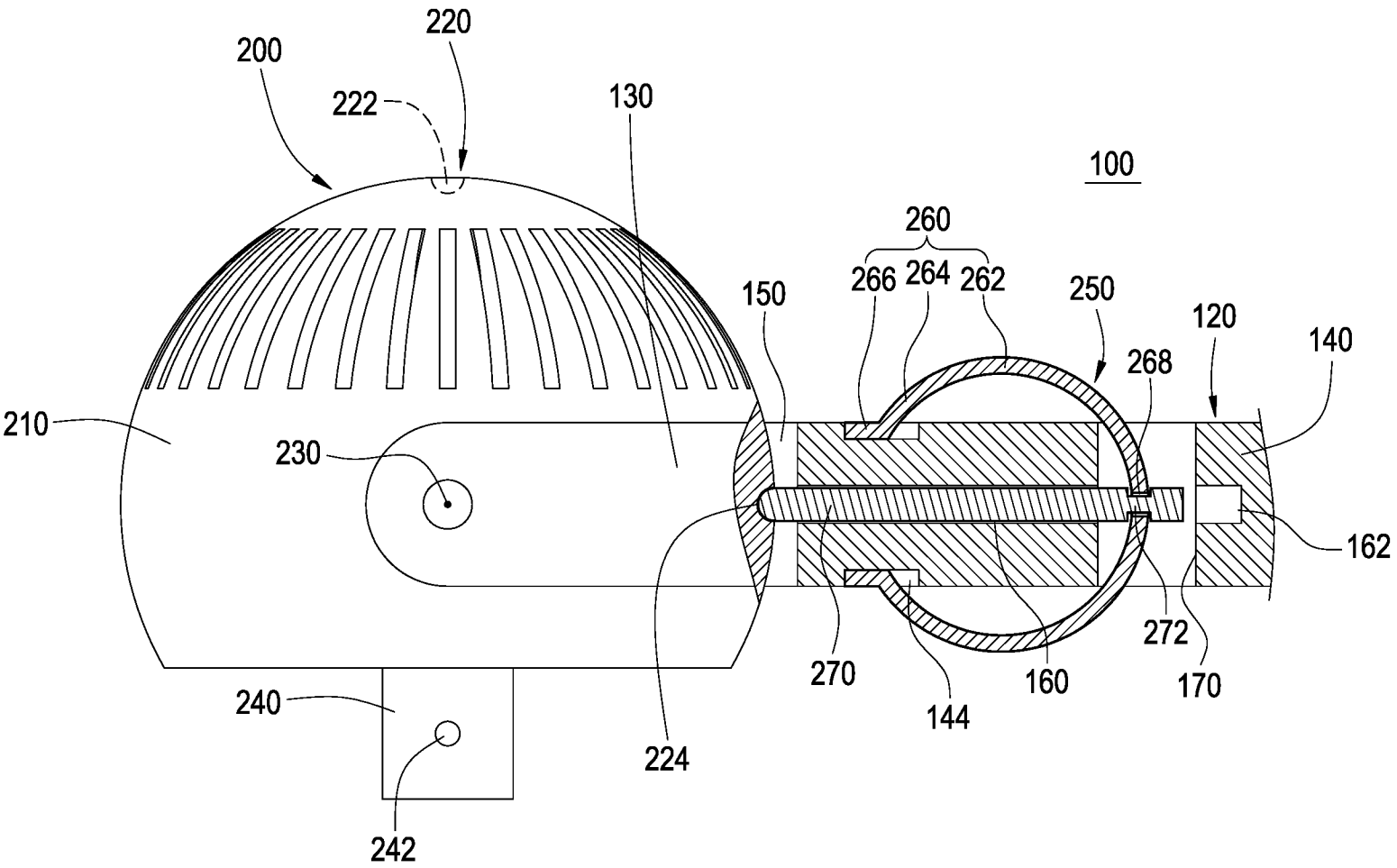
FIG. 6 is a partial cross-sectional view of FIG. 5.

When the locking button 250 is in the released state, the user can freely rotate the rotary head 200 to an angle shown in FIGS. 5 and 6. When the flexible fastener 260 is released, the connection portion 262 recoils to drive the latch bar 270 to protrude out, so that the latch bar 270 is again engaged with the second positioning recess 224 of the rotary head 200.

Therefore, the present invention is very simple and easy to operate and has a simple structure. By pressing the flexible fastener 260 of the locking button 250, and rotating the rotary head 200 to the desired positioning recess 222, 224, and then releasing the locking button 250, the rotary head 200 can be fastened and locked quickly. Furthermore, the locking button 250 can automatically keep the locked state. In other words, the locking button 250 of the present embodiment is kept in a normal close state without the necessity of additional operations, so the rotary head 200 is locked against free rotation, and thereby the present invention is safe and convenient in operations.

It is to be understood that the above descriptions are merely the preferable embodiment of the present invention and are not intended to limit the scope of the present invention. Equivalent changes and modifications made in the spirit of the present invention are regarded as falling within the scope of the present invention.

What is claimed is:

1. A ratchet wrench having a flexible positioning structure, comprising:

a drive bar, the drive bar including a fork arm, a fork opening formed at the fork arm, an axial hole communicating with the fork opening, and a radial hole communicating with the axial hole;

a rotary head, the rotary head being pivotally connected to two ends of the fork arm, the rotary head including a round housing, a ratchet apparatus disposed inside the round housing, a plurality of positioning recesses disposed on the round housing, and a pivot axis formed at the rotary head and passing through the two ends of the fork arm, wherein the pivot axis is perpendicular to the radial hole; and a locking button, the locking button including a flexible fastener inserted through the radial hole and a latch bar disposed in the axial hole, the flexible fastener being flexibly movable in association with movement of the latch bar, the latch bar being engaged with or released from any of the positioning recesses, wherein the flexible fastener includes a connection portion and two end portions, and the two end portions are integrally formed with the connection portion;

wherein the connection portion is inserted through the radial hole, and the two end portions protrude out of the radial hole and are in contact with a surface of the drive bar.

2. The ratchet wrench having the flexible positioning structure of claim 1, wherein the drive bar includes two indentations, the flexible fastener includes two bend portions connected to the two end portions, and the two bend portions are respectively disposed at the two indentations.

3. The ratchet wrench having the flexible positioning structure of claim 1, wherein the latch bar includes a fastening portion, and the connection portion includes a through hole or an opening engaged with the fastening portion.

4. The ratchet wrench having the flexible positioning structure of claim 3, wherein the fastening portion is an annular groove, and the annular groove is engaged with the through hole or the opening.

5. The ratchet wrench having the flexible positioning structure of claim 1, wherein the drive bar further includes an accommodating recess communicating with the radial hole, and the accommodating recess is disposed corresponding to the axial hole.

6. The ratchet wrench having the flexible positioning structure of claim 1, wherein a cross section of the flexible fastener is a flat plate structure, and the flat plate structure is parallel to a surface of the drive bar.

7. The ratchet wrench having the flexible positioning structure of claim 1, wherein the flexible fastener is a C-shaped fastener, a trapezoidal fastener or a polygonal fastener.

8. The ratchet wrench having the flexible positioning structure of claim 1, wherein the drive bar further includes an enlarged end and a bar body, the enlarged end is disposed between the fork arm and the bar body, and the axial hole and the radial hole are disposed at the enlarged end.

9. The ratchet wrench having the flexible positioning structure of claim 1, wherein each of the positioning recesses at least includes a first positioning recess disposed on a top of the round housing and a second positioning recess disposed at a side surface of the round housing.

10. The ratchet wrench having the flexible positioning structure of claim 9, wherein the first positioning recess and the second positioning recess form an included angle of 90 degrees therebetween.

* * * * *